US010281235B1

(12) United States Patent
White

(10) Patent No.: US 10,281,235 B1
(45) Date of Patent: May 7, 2019

(54) SLING FOR A FIREARM

(71) Applicant: Justin White, Arab, AL (US)

(72) Inventor: Justin White, Arab, AL (US)

( * ) Notice: Subject to any disclaimer, the term of this patent is extended or adjusted under 35 U.S.C. 154(b) by 0 days.

(21) Appl. No.: 16/050,308

(22) Filed: Jul. 31, 2018

Related U.S. Application Data

(63) Continuation of application No. 15/974,878, filed on May 9, 2018.

(60) Provisional application No. 62/503,556, filed on May 9, 2017.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 23/02
USPC ..... 224/150
See application file for complete search history.

(56) References Cited

U.S. PATENT DOCUMENTS 3,495,770 A * 2/1970 Rolling ..... F41C 33/002 224/150
3,595,451 A * 7/1971 Branby ..... F41C 33/002 224/150
3,655,106 A * 4/1972 Wojcinski ..... A45F 5/00 224/150
3,948,423 A * 4/1976 Hathaway ..... F41C 33/001 224/150
4,249,686 A * 2/1981 Morwood ..... F41C 33/002 224/150
4,768,689 A * 9/1988 Davis ..... A45F 3/14 224/150
4,817,835 A * 4/1989 Tarr, Jr. ..... F41C 33/002 224/150
5,082,155 A * 1/1992 Salvador ..... F41C 33/001 224/150
D342,563 S * 12/1993 Tukiendorf ..... D3/259
5,282,558 A * 2/1994 Martinez ..... F41C 33/002 224/150
5,802,756 A * 9/1998 Hightower ..... F41C 33/002 42/85
5,810,219 A * 9/1998 Rosenfield ..... F41C 33/001 224/149
6,581,812 B2 * 6/2003 Roscoe-Dare ..... A45F 3/14 224/257
7,270,254 B2 * 9/2007 Kakouras ..... F41C 23/02 224/150
7,959,046 B2 * 6/2011 Burnsed, Jr. ..... F41C 33/001 224/150

(Continued)

*Primary Examiner* — Peter N Helvey
(74) *Attorney, Agent, or Firm* — Eric B. Fugett; Mark A. Pitchford; Pitchford Fugett, PLLC

(57) ABSTRACT

The invention is a versatile and modular sling for carrying a firearm around a user's neck, torso, or over one shoulder. The sling includes a closed sling loop formed from an elastic cord, a primary strap secured to a portion of the sling loop that is operable to anchor the sling loop in a given orientation relative to the firearm, and a secondary strap releasably attached to the sling loop that is slidable along the length of the sling loop to easily convert the sling between one-point, two-point, and three-point configurations. The sling can be attached to the firearm by use of studs or swivels in a conventional manner or can be attached directly to the firearm by using adjustable loops at each end of each strap.

10 Claims, 13 Drawing Sheets

(56) References Cited

U.S. PATENT DOCUMENTS

| | | | | |
|---|---|---|---|---|
| 7,988,023 | B1 * | 8/2011 | Nykoluk | F41C 33/002 224/150 |
| 2006/0011677 | A1 * | 1/2006 | Burnsed, Jr. | F41C 33/001 224/150 |

* cited by examiner

SLING FOR A FIREARM

CROSS-REFERENCES TO RELATED APPLICATIONS

This application is a continuation of U.S. patent application Ser. No. 15/974,878, filed May 9, 2018 and entitled "SLING FOR A FIREARM," which claims priority to U.S. Provisional Patent Application Ser. No. 62/503,556[,] entitled "WEAPON SLING" and filed May 9, 2017, the contents of both of which applications are incorporated herein in their entirety by this reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a device for carrying a firearm. More specifically, the present disclosure relates to a modular, adjustable sling for a firearm formed from a closed loop of elastic cord having at least one removable strap releasably attached to and in slidable engagement with the loop to enable quick and easy switching between multiple sling configurations suited to different carrying and firing positions.

Slings for a firearm (e.g., a rifle, shotgun, smooth bore firearm, bullpup style firearm, or large-frame pistol) support the weight of the firearm on a portion of a user's body and can be used to stabilize the firearm during the act of shooting. Many different kinds of slings are known. Some are used over one shoulder, others are used over both shoulders, still others go over the shooter's head and around the neck or around the body. Some use a single strip of leather or other material while others use multiple strips. The most common slings traditionally come in the form of a flexible, adjustable strap that connects to the firearm at one or more locations by means of a swivel device such as a sling swivel or mechanical hook. Adjustment of such slings is made possible by the use of such hardware as slides, buckles, clasps, clamps hooks, rivets, screws or other devices.

The three main types of slings in common use today include single-point, two-point, and three-point slings. A "single-point" sling is so named because it connects to the firearm at one location at or near the rear end of the firearm, such as the rear end of the receiver or action of the firearm. By contrast, a "two-point" sling connects to the firearm at two locations on the firearm, typically at or near the rear and the front ends of the firearm, such as butt stock and fore-end, respectively. A "three-point" sling connects to the firearm at two locations like a two-point sling, but includes a portion that also goes around a user's body (i.e., torso). Each sling type offers various advantages and disadvantages that affect its suitability for different hunting, tactical and other shooting applications.

Single-point slings are traditionally worn around the user's neck or, in some cases, cross-body around the user's neck and torso (i.e., with the head, an arm, and a shoulder extending through the sling), with the firearm hanging down the front, side, or back of the user. The front-carry position is ideal for tactical applications where a user may need to quickly go hands-free (i.e., release or unhand the firearm without dropping it to the ground) but must also be able to quickly retrieve the firearm and move into a shooting position. Single-point slings also advantageously allow the user to cleanly perform a wide range of transitional movements (e.g., moving the firearm from one hand to the other, switching to a different weapon, and moving into a shooting position). However, single point slings place the entire weight of the firearm on one side of the user's neck and provide little to no stabilizing support during the act of shooting. They also disadvantageously allow the firearm to sway and bump into portions of the user's body such as the groin and knees when the firearm is not being held by the user. This makes single-point slings impractical for applications that may involve running, such as combat or tactical maneuvers.

Two-point slings are traditionally used to carry the firearm over the back of one shoulder with the muzzle up or down. These slings are most commonly used to carry a firearm over a long trek such as might be encountered while hunting. They can be used to stabilize the firearm during the act of shooting by looping the forward portion of the sling around the user's non-dominant arm to place tension on the sling and keep the fore-end of the firearm stable for more accurate shooting. The downside of two-point slings includes that they focus the weight of the firearm on only one shoulder, leaving the user or wearer unbalanced while carrying the firearm, which can make it difficult for the user to run or climb when needed. Two-point slings can also make it difficult for a user to transition the firearm from side to side or to retrieve the firearm and move into a shooting position, which is problematic in situations where time is of the essence and economy of movement is vital.

Three-point slings are traditionally worn around a user's torso with the firearm leveled (i.e., horizontal relative to the ground) on either side or across the front of the user. A major benefit of three-point slings is that they allow for easy and clean transitions from a primary firearm (e.g., a rifle or shotgun) connected to the sling, to a secondary sidearm (e.g., a handgun) secured to the user's waist or thigh. Three-point slings also advantageously keep the firearm proximate to the user's body within easy reach, and provide the user with more control over the firearm than a single-point sling when moving without holding the firearm in the user's hands. This prevents the firearm from contacting the user's legs or groin and thereby slowing the user while running or climbing. However, three-point slings tend to get caught on bolt release mechanisms and items of clothing or other equipment worn by the user, and can block the ejection ports of some firearms. In this way, three-point slings tend to be more difficult to use than single- and two-point slings as users can easily become tangled in the sling while entering or removing the sling, which can be dangerous to the user as well as others.

No presently available sling provides comfortable and uniform weight distribution for sustained carry while combining the various advantages of the foregoing sling types into one simple and easy to use sling that can be quickly converted between all three sling configurations to suit different carrying and firing positions. What is needed then are improvements in slings for firearms.

BRIEF SUMMARY

Aspects of the present disclosure overcome or minimize some or all of the shortcomings of the prior art by providing a comfortable, adjustable sling for supporting the weight of a firearm and maintaining the firearm proximate to a user's body.

The sling disclosed herein has an overall shape like an inverted and elongated teardrop with relatively shorter adjustable straps extending from each end. The teardrop-shaped central portion of the sling (often referred to herein as the "sling loop") is formed from a length of elastic cord, the ends of which are joined to form a closed loop large enough to fit around a portion of a user's body, such as the user's head or head, arm, and shoulder. The end of each adjustable strap distal to the sling loop includes means for releasably attaching the sling to a firearm. One of the straps is permanently secured to the narrow portion of the sling loop to anchor the sling to the firearm. Anchoring the narrow portion of the sling loop to the firearm ensures that the sling can freely rotate around the portion of the user on which the sling is worn as the firearm and the narrow portion of the loop moves around the user's body during use or carry. The other strap is releasably attached to the wider curved portion of the sling loop and is operable to slide along the length of the sling loop (e.g., the curved portion of the sling loop). This unique combination of features of the presently disclosed sling allows a user to customize how the user carries and uses the firearm by manually sliding the releasable strap (interchangeably referred to herein as the "detachable strap") along the length of the sling loop to suit the user's preferred carrying or firing position, and to easily convert the sling between one-point, two-point, and three-point sling configurations.

With the releasable strap released from the sling loop, the sling can be used as a single-point sling to carry a firearm around the user's neck or torso. With the releasable strap attached, the sling can be used as a two-point sling to carry a firearm in the ordinary manner, over one shoulder, or as a three-point sling to carry the firearm around the user's neck or body. When carried in a three-point configuration, the releasable (i.e., detachable) strap can be manually slid along the sling loop to position the strap in any desired position relative to the user's back (i.e., between the user's shoulder blades). Once in the desired position, the weight of the firearm will cause the elastic cord to stretch, hold the releasable strap in place on the sling loop, and distribute the weight of the firearm uniformly around the user's shoulders without placing pressure on or straining the user's neck, thereby reducing or eliminating user fatigue.

It is one objective of the present disclosure to provide a sling for a firearm that is adjustable in both length and fit, yet that is simple in design, while being easy to use and manufacture.

It is a further objective of the present disclosure that the sling is quickly and easily convertible between one-point, two-point, and three-point sling configurations without the use of tools.

It is a further objective of the present disclosure that the sling is usable with any virtually any long gun, and provides uniform weight distribution of the firearm around a user's shoulders without placing pressure on the user's neck to reduce or eliminate user fatigue.

Accordingly, in one aspect of the disclosure is a sling for a firearm that includes a length of elastic cord formed in a closed loop, which can optionally be a static loop. The closed loop has an opening sized to receive the head of a wearer or user. A primary strap is secured to a lower portion of the closed loop, and a secondary strap is releasably attached to an upper portion of the closed loop. The sling is operable to support and distribute the weight of a firearm around the user's torso and maintain the firearm proximate to the user's body when the primary and secondary straps are connected to the firearm and the user's head is inserted through the closed loop.

In another aspect, a sling for a firearm includes an elastic cord, a primary strap, and a secondary strap. The elastic cord has a longitudinal axis and two end portions, and each end portion has an end. The cord is arranged in a closed loop wherein the end portions are disposed side by side with ends facing in the same direction. The primary strap has a distal end portion and a proximal end portion. The distal end portion of the primary strap includes firearm attachment means for releasably attaching the primary strap to a first portion of a firearm. The proximal end portion of the primary strap is secured to the two end portions of the cord. The secondary strap has a distal end portion and a proximal end portion. The distal end portion of the secondary strap includes firearm attachment means for releasably attaching the secondary strap to a second portion of a firearm. The proximal end portion of the secondary strap is in slideable frictional engagement with the closed loop such that the secondary strap is manually slidable along the longitudinal axis of the cord to adjust the sling to suit different carrying and firing positions while the distal ends of the primary and secondary second straps are connected to the firearm and a user's head is inserted through the closed loop.

In yet another aspect, a sling for a firearm includes an elastic cord, a primary strap assembly, and a secondary strap assembly. The elastic cord has a longitudinal axis, a first end, and a second end. The second end is connected to the first end such that a segment of the cord extending between the first and second ends defines a closed loop. The closed loop is sized to receive a user's head, and optionally, a user's arm and adjoining shoulder. The primary strap assembly has a proximal end portion attached to the closed loop and a distal end portion provided with means for releasably attaching to a firearm. The secondary strap assembly has a proximal end portion and a distal end portion. The distal end portion of the secondary strap is provided with means for releasably attaching to a firearm. The proximal end portion of the secondary strap is releasably attached to the segment of cord extending between the first and second ends of the elastic cord. The sling is operable to support and distribute the weight of a firearm around the user's torso and maintain the firearm proximate to the user's body when the primary and secondary strap assemblies are connected to the firearm and the user's head is received in the closed loop.

Numerous other objects, advantages and features of the present disclosure will be readily apparent to those of skill in the art upon a review of the following drawings and description of a preferred embodiment.

BRIEF DESCRIPTION OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
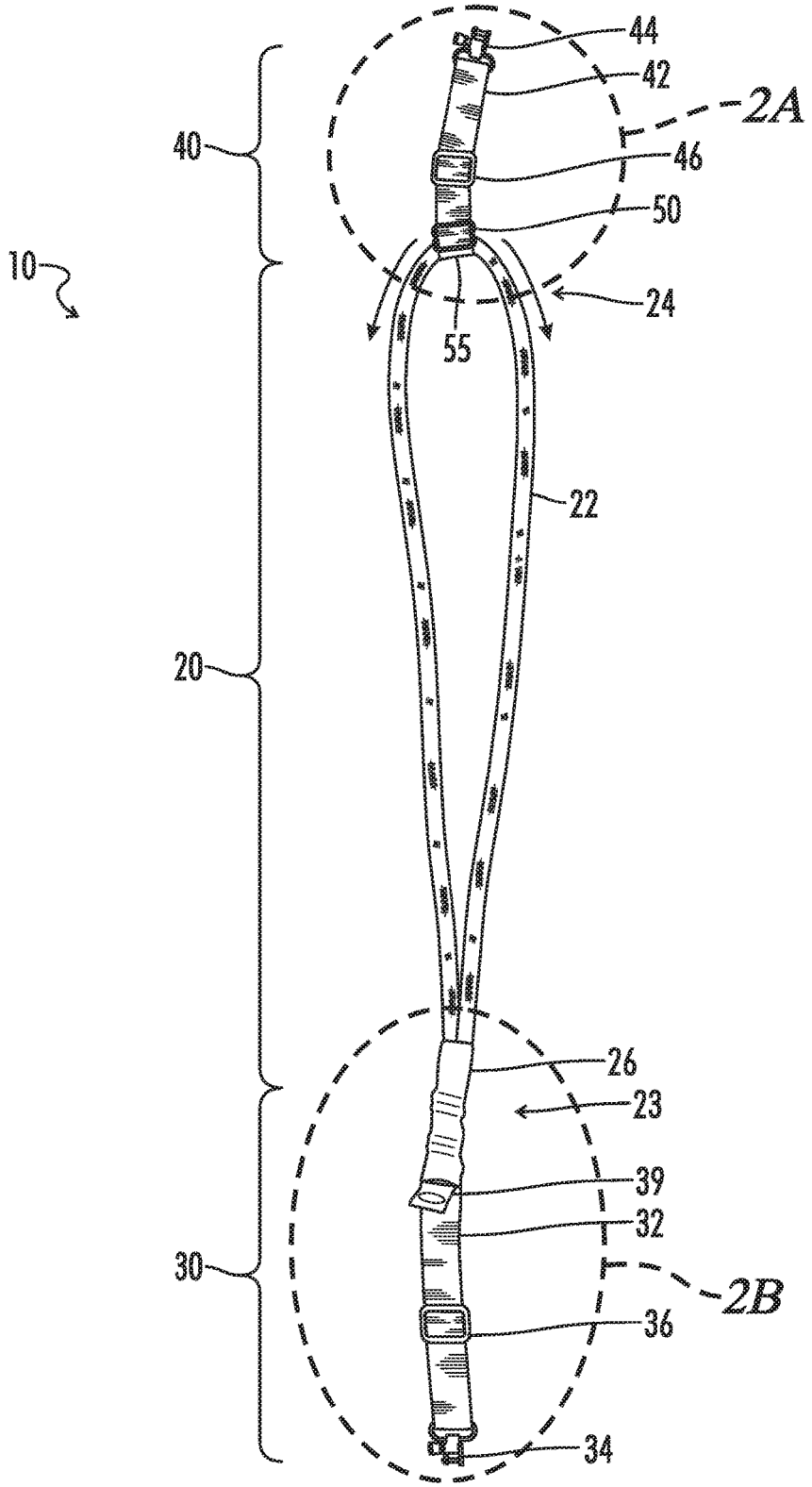
FIG. 1 is a front perspective view of an embodiment of a sling for a firearm constructed in accordance with the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the portions relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Referring to FIGS. 6-9, a sling for a firearm 10 is a device for carrying a firearm such a shotgun 60 or rifle 70 and maintaining the firearm proximate to the body of a user 90 when the sling 10 is releasably attached to the firearm and a portion of the user's body such as the user's head is received in the sling 10.

As shown in FIGS. 1-5, in one embodiment, a sling for a firearm 10 includes a large closed loop 20 (also referred to herein as the "sling loop"), a primary strap assembly 30 connected to a lower portion of the sling loop 20, and a secondary strap assembly 40 connected to an upper portion of sling loop 20. The sling loop 20 is formed from a flexible elastic cord 22, which in some embodiments, can be a rubber cord or bungee cord. The elastic cord 22 has a diameter, a longitudinal axis, a first end segment 25*a* with a first end 27*a*, a second end segment 25*b* with a second end 27*b*, and a length extending from the first end 27*a* to the second end 27*b*. In some embodiments, the cord 22 has a diameter of approximately ⅜ inches, and a length of from about 40 to about 65 inches. However, the diameter and length of the cord 22 can be varied to accommodate the height and frame of a user or the weight and size of the firearm to which the sling 10 will be attached.

Unlike traditional slings that use one or more typically thin, flat, leather or synthetic straps as the primary structure that supports the weight of a firearm, the sling of the present disclosure advantageously uses a cord having a generally rounded cross section as the primary structure that supports the weight of an attached firearm. As will be explained in more detail below with reference to an exemplar embodiment, the use of a cord having a substantially circular cross section permits a user to slide the secondary strap assembly 40 along the length of sling loop 20 and thereby customize the configuration and fit of the sling 10.

The sling loop 20 is formed by arranging the elastic cord 22 into a closed loop, which in some embodiments, can be a static loop having the shape of an elongated teardrop. The loop 20 is at least large enough to receive a user's head so that the user can easily insert the user's head, and in some embodiments, the user's arm and shoulder, through the loop 20.

Figure 5A:
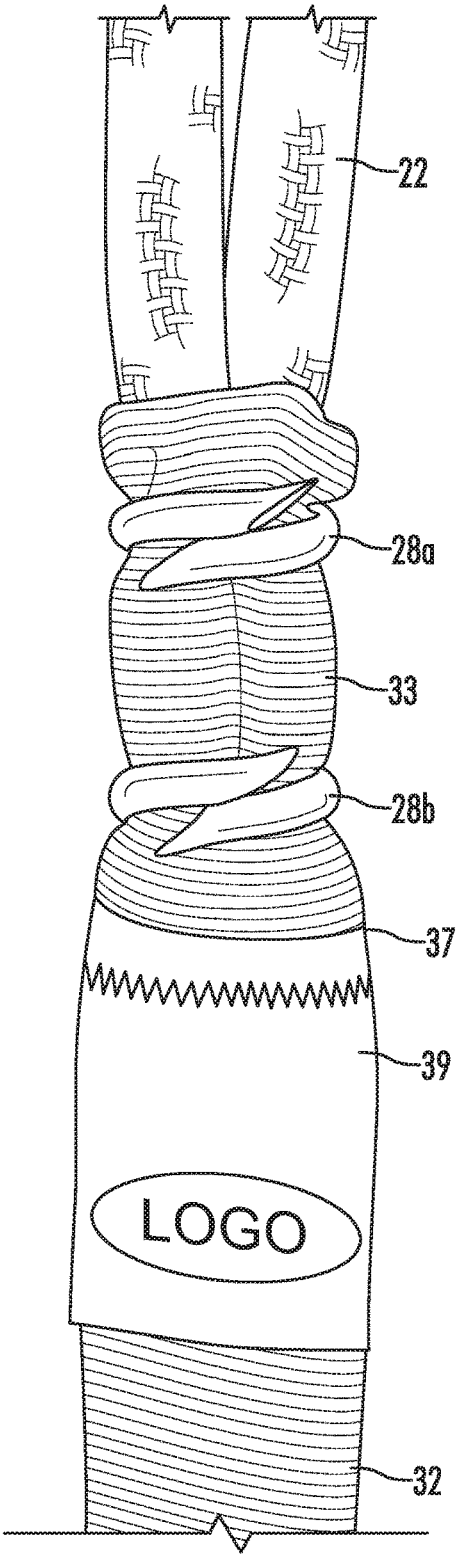
FIG. 5A is an enlarged view of the inset of FIG. 2B showing the lower strap assembly attachment portion with the flexible covering removed.
Figure 5B:
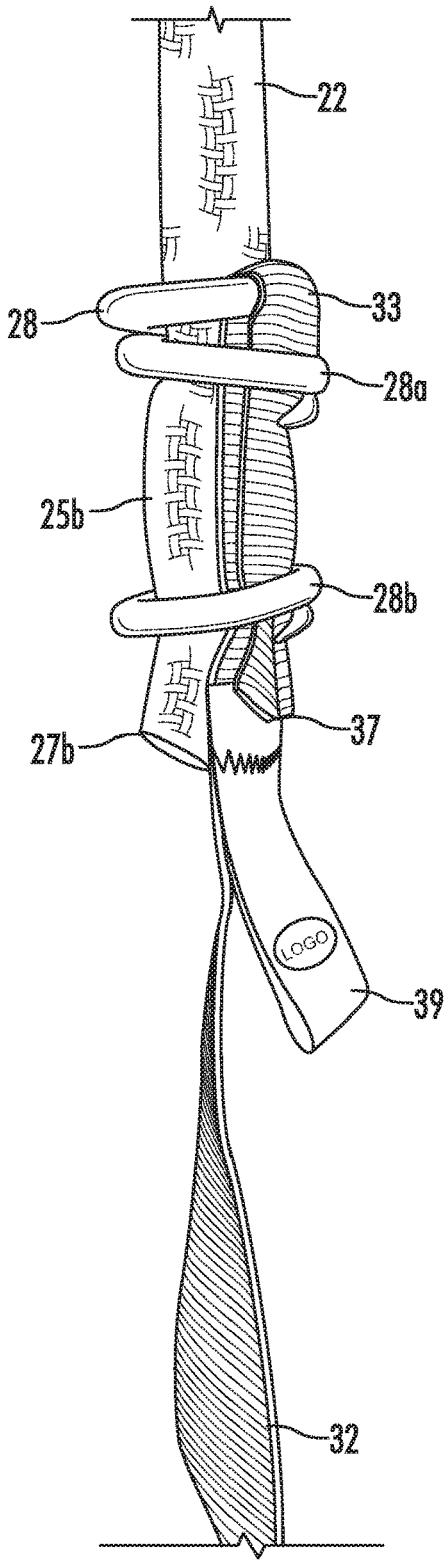
FIG. 5B is a perspective side view of the lower strap assembly attachment portion of FIG. 5A.
Figure 5C:
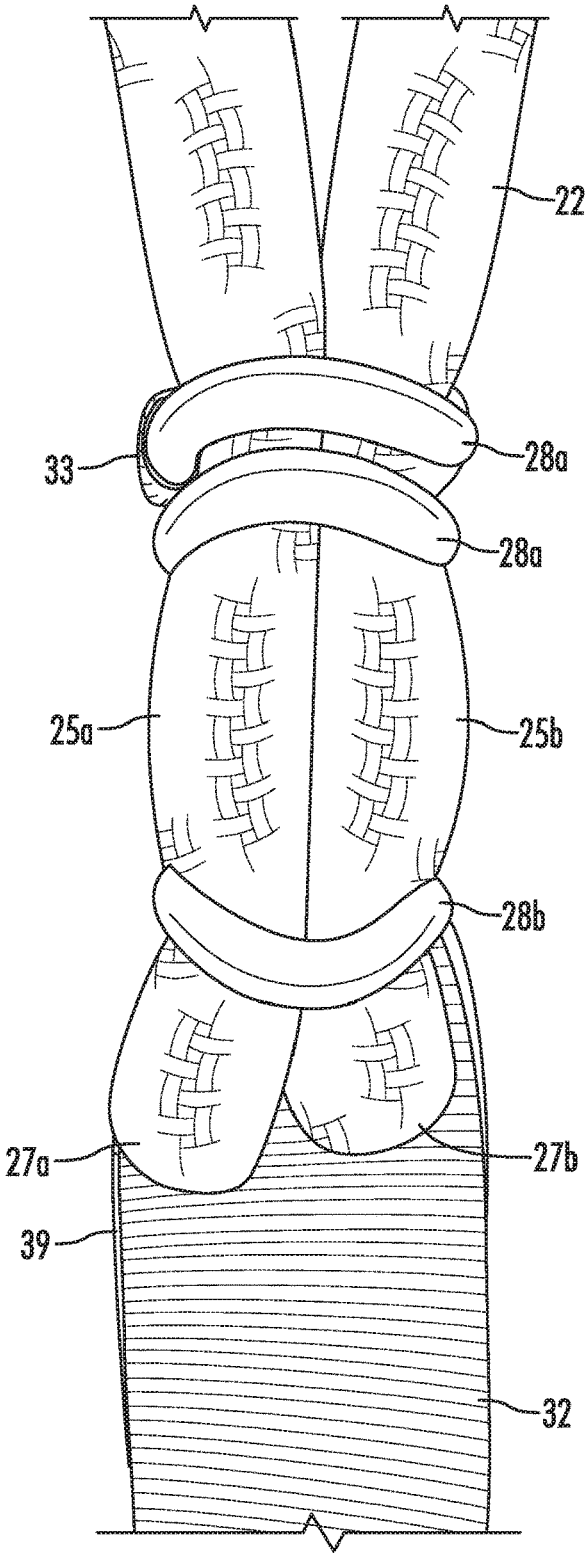
FIG. 5C is a perspective rear view of the lower strap assembly attachment portion of FIG. 5A.

In the embodiment exemplified in FIG. 1, the sling loop 20 is formed by folding the cord 22 in half and placing the first end segment 25*a* adjacent and parallel to the second end segment 25*b* with the ends 27*a*, 27*b* of both segments facing in the same direction, as shown in FIG. 5C. The end segments 25*a*, 25*b* are connected by clamping means 28*a*, 28*b* having sufficient compressive force to compress or crimp the end segments 25*a*, 25*b* together and thereby prevent the end segments 25*a*, 25*b* from separating or pulling apart when the sling 10 is attached to and supporting the weight of a firearm on a user 90. Suitable clamping means 28 for connecting the end segments 27*a*, 28*a* of the cord 22 include, but are not limited to, clamps, hog rings, zip ties, adhesive tape, and the like. In other embodiments, the sling loop 20 can be formed by connecting the first end 27*a* of the cord 22 directly to the second end 27*b* of the cord 22, for example, by fusing or adhering end 27*a* to end 27*b*. In still other embodiments, the sling loop 20 can be formed by tying the first and second cord end segments 25*a*, 25*b* together.

The sling loop 20 includes a lower strap assembly attachment portion 23 and an upper strap assembly attachment portion 24. The lower strap assembly attachment portion 23 includes the first and second end segments 25*a*, 25*b* of the cord 22 forming the lower narrow portion of the sling loop 20 shown in FIG. 1. The upper strap assembly attachment portion 24 includes the bend 24 in the elastic cord 22 forming the upper wider portion of the sling loop 20 shown in FIG. 1. The primary strap assembly 30 is permanently secured to the lower portion of the sling loop 20 at the lower strap assembly attachment portion 23, and the secondary strap assembly 40 is releasably attached to the upper portion of the sling loop 20 at the upper strap assembly attachment portion 24.

Referring now to FIGS. 2A, 3A, 4A and 4D, the secondary strap assembly includes a secondary strap 42, a rounded slide 50, an adjustable slide 46, and a firearm attachment means 44. The secondary strap 42 has a length defining a longitudinal axis, a width, a distal end portion 41 with a distal end 45, a proximal end portion 43 with a proximal end 47. The secondary strap 42 can be formed from any strong but flexible synthetic or natural material, including but not limited to nylon webbing and leather. In some embodiments, the secondary strap 42 has a width of approximately 1.0 inches and a length of from about 12 to about 20 inches. In a preferred embodiment, the secondary strap 42 has a width of approximately 1.0 inches and a length of approximately 16 inches. However, the width and length of the secondary strap 42 can be varied to suit the height and frame of the user 90, or the size and weight of the firearm.

Figure 4A:
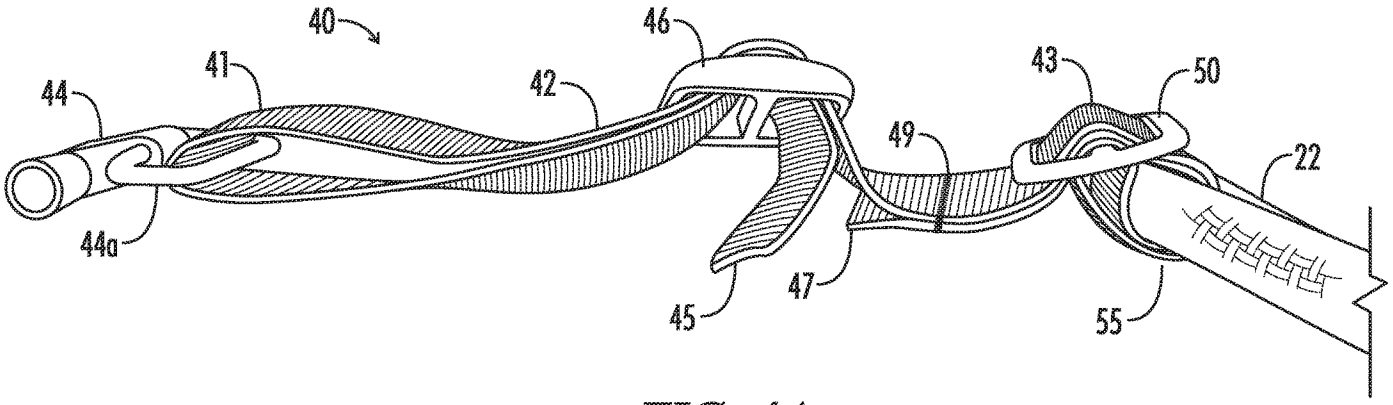
FIG. 4A is a perspective side view of the secondary strap assembly of FIG. 2A.
Figure 4B:
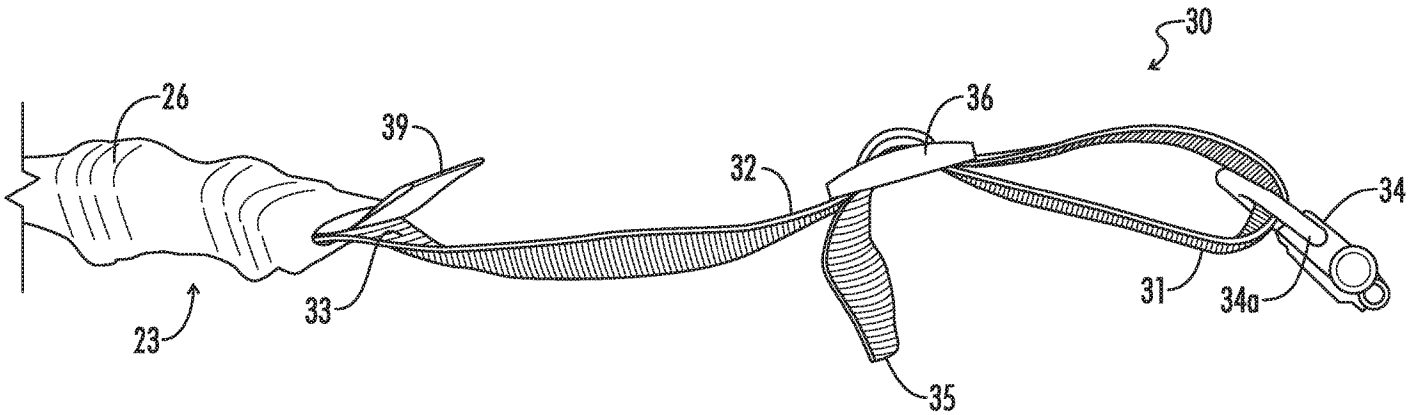
FIG. 4B is a perspective side view of the primary strap assembly shown in FIG. 2B.
Figure 4C:
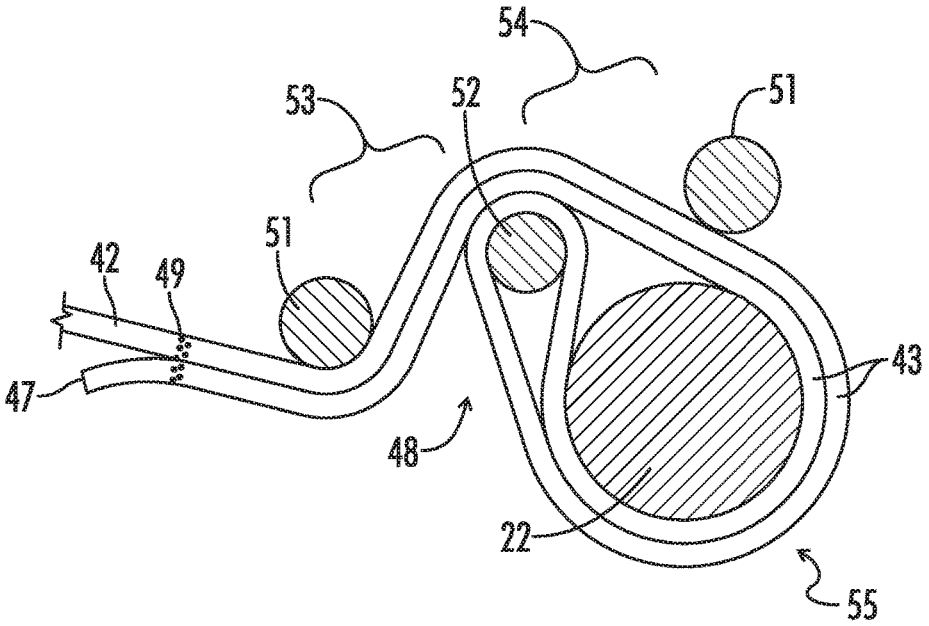
FIG. 4C is a sectional view taken along line 4-4 of FIG. 2A.
Figure 4D:
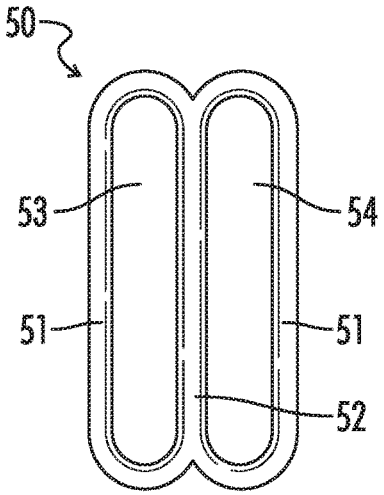
FIG. 4D is a plan view of the rounded metal slide shown in FIG. 4A.

As illustrated in FIG. 4D, the rounded slide 50 includes an exterior frame 51 having a central bar 52 defining first and second slots 53, 54 between the central bar 52 and the exterior frame 51. The rounded slide 50 can be formed from a metallic or plastic material, but in an embodiment is preferably formed from a durable metal material. The use of a strong metal slide 50 reduces the chances that the slide 50 will fail and cause unintentional separation of the secondary strap 42 from the sling loop 20 during use of the sling 10, which is undesirable.

The adjustable slide 46 has a well-known design that will be familiar to skilled artisans and is structurally similar to slide 50, except that the frame and central bar of adjustable slide 46 may not be rounded and the exterior of the frame includes outwardly extending tabs to facilitate movement of the slide by a user along the secondary strap 42 to which it is connected. The adjustable slide 46 can be formed from a metallic or plastic material, but in an embodiment is preferably formed from a resilient plastic to reduce the overall weight of the sling 10.

Figure 2A:
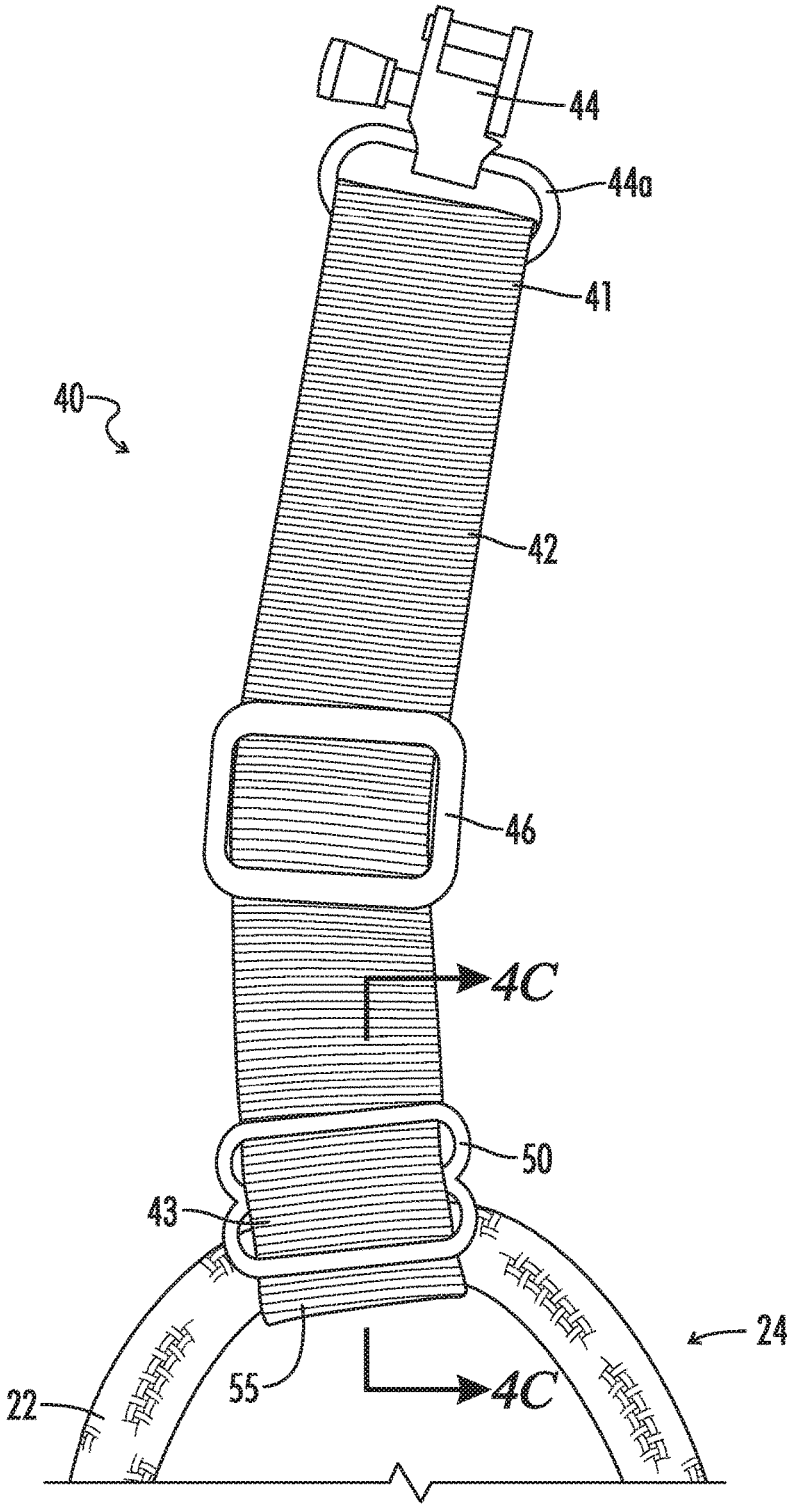
FIGS. 2A and 2B are enlarged views of the insets of FIG. 1 showing a secondary strap assembly and a primary strap assembly, respectively.
Figure 3A:
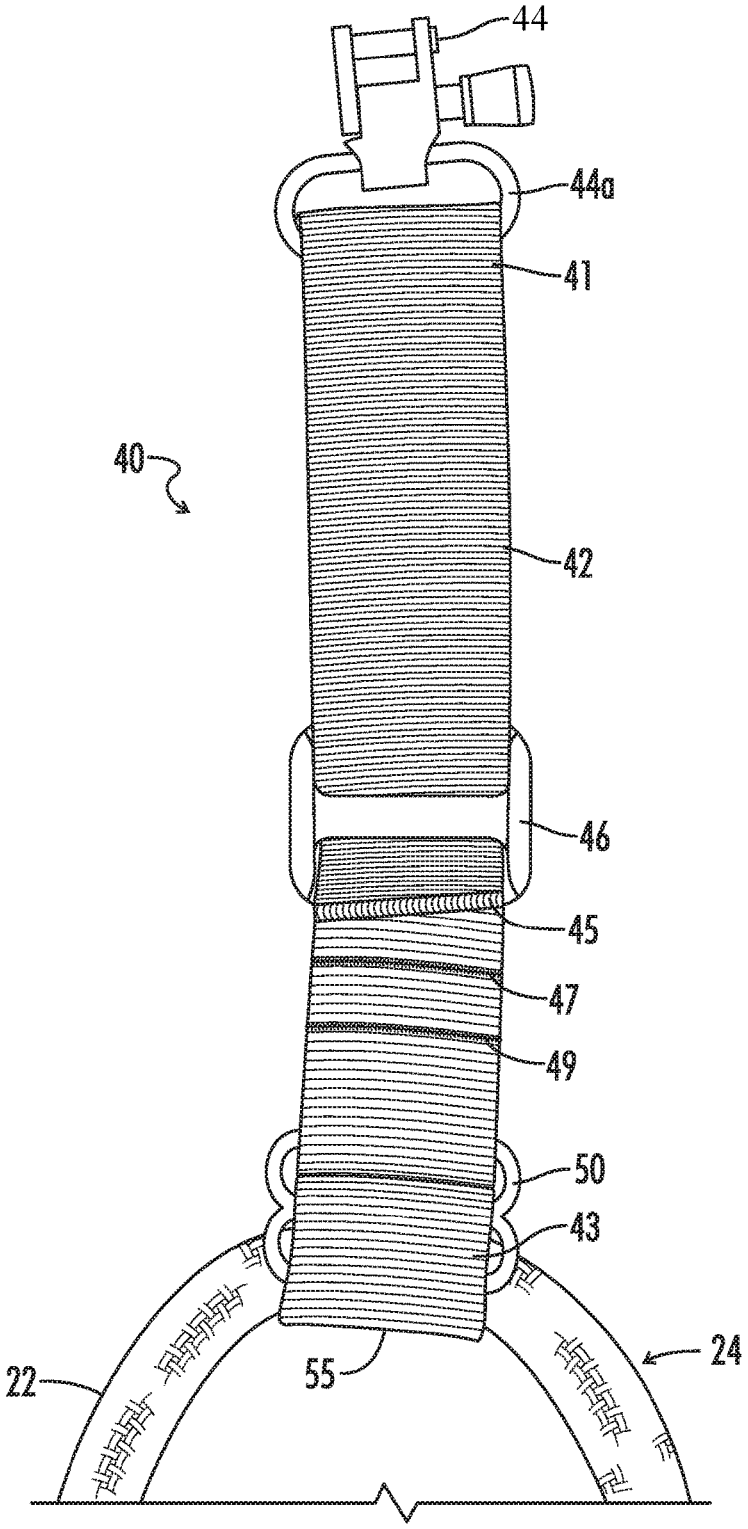
FIGS. 3A and 3B are perspective rear views of the assemblies shown in FIGS. 2A and 2B, respectively.

The firearm attachment means 44 is a standard sling swivel 44 having a ring 44*a* around which a portion of the secondary strap 42 can be looped as shown in FIGS. 2A, 3A, and 4A. However, in other embodiments, the firearms attachment means 44 can be a quick detach sling swivel, a mechanical snap hook or D-ring, a carabiner, a trigger snap, a spring link, or a length of the distal end portion 41 of the secondary strap 42 sufficient to be tied to a portion of a firearm.

As best shown in FIGS. 4A and 4C, the proximal end portion 43 of secondary strap 42 is connected to the upper strap assembly attachment portion 24 of the sling loop 20 by a dual loop arrangement. The first loop 48 of the dual loop arrangement is a closed loop 48 formed around the central bar 52 of the rounded metal slide 50 by the proximal end portion 43 of the secondary strap 42. The closed loop 48 is formed by threading the proximal end 47 of strap 42 up from the bottom of rounded metal slide 50 through first slot 53, over central bar 52, and back down from the top of slide 50 through second slot 54. The proximal end 47 of the secondary strap is secured to a portion of the strap 42 distal to the proximal end 47 at seam 49 by a double row of stitching to provide added strength to the double loop arrangement. However, in other embodiments, the proximal end 47 of the secondary strap is not sewn or otherwise secured to the secondary strap 42.

The second loop 55 of the dual loop arrangement is an adjustable loop 55 formed around a section of elastic cord 22 at the upper strap assembly attachment portion 24 of sling loop 20. Specifically, adjustable loop 55 is formed around cord 22 by the two overlapping and aligned layers of strap 42 forming closed loop 48 and extending generally downwardly from central bar 52, as shown in FIG. 4C. The two overlapping layers of proximal end portion 43 extend generally downward from central bar 52, around cord 22, up through second slot 54, over the portion of strap 42 forming closed loop 48 around central bar 52, and down through first slot 53. Once closed loop 48 is formed around central bar 52 with proximal end portion 43, adjustable loop 55 can be formed by wrapping the two overlapping layers of proximal end portion 43 extending generally downward from central bar 52 around cord 22 and threading the distal end 45 of strap 42 up from the bottom of rounded metal slide 50 through second slot 54, over central bar 52, and back down from the top of slide 50 through first slot 53.

Adjustable loop 55 can be tightened around and frictionally engaged with cord 22 to selectably retain secondary strap 42 in place on the sling loop 20 by holding slide 50 and pulling the distal end portion 41 of strap 42 away from adjustable loop 55. Adjustable loop 55 can also be tightened around cord 22 by holding a portion of strap 42 distal to slide 50, and applying longitudinal pressure to the sides of slide 50 to slide the slide along the longitudinal axis of strap 42 toward the sling loop 20. Adjustable loop 55 can be loosened around cord 22 to facilitate easier sliding of adjustable loop 55 along sling loop 20 by holding slide 50 and pulling the portion of proximal end portion 43 forming adjustable loop 55 back down through second slot 54. Strap 42 can be released from the sling loop 20 by withdrawing the distal end 45 of strap 42 from the slots 53, 54 of slide 50. In this way, the proximal end portion 43 of the secondary strap 42 is releasably attached to and in slidable frictional engagement with sling loop 20.

This dual loop arrangement allows a user to quickly and easily change the position of the secondary strap 42 on the sling loop 20 to customize sling 10 to accommodate different carrying and firing positions by manually sliding the adjustable loop 55 along the longitudinal axis of the cord 22 forming sling loop 20 as indicated in FIG. 1. It also permits a user to quickly and easily detach or release the secondary strap assembly 40 from the sling loop 20 to convert the sling 10 from a two-point or three-point sling into a single point sling.

Referring again to FIGS. 2A, 3A, and 4A, the distal end portion 41 of secondary strap 42 is releasably attached to firearm attachment means 44 by an adjustable loop formed with slide 46 around ring 44*a* of sling swivel 44. The loop is formed by threading the distal end 45 of strap 42 up from the bottom of adjustable slide 46 through the one slot of the slide, over the central bar, back down from the top of the slide 46 through the second slot, through ring 44*a* of sling swivel 44, then back up from the bottom through the second slot, over the central bar and under the overlying layer of strap 42, and back down and out the first slot. The adjustable loop can be lengthened by holding a portion of strap 42 proximal to adjustable slide 46, and applying longitudinal pressure to the sides of slide 46 to slide the slide along the longitudinal axis of strap 42 toward the firearm attachment means 44. The loop can be shortened by holding the slide 46 and pulling the distal end 45 of strap 42.

Figure 2B:
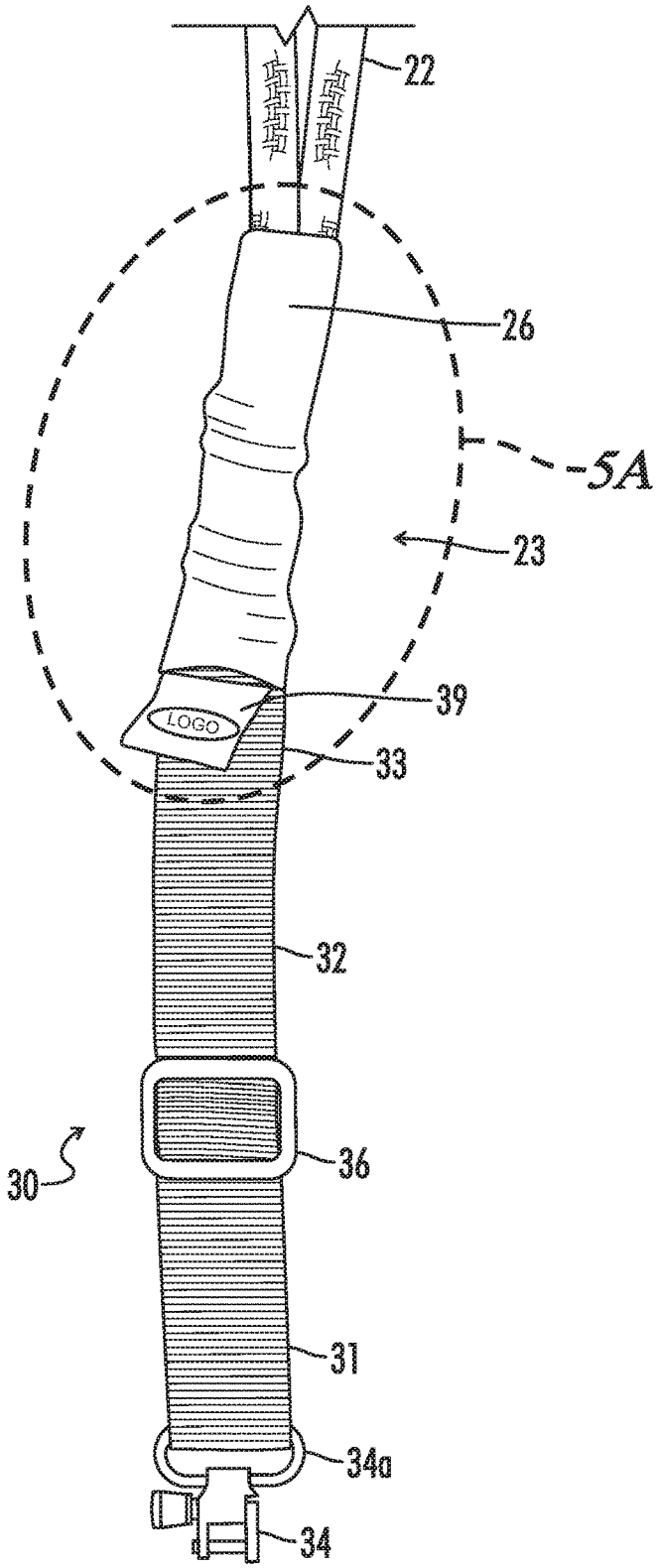
Figure 3B:
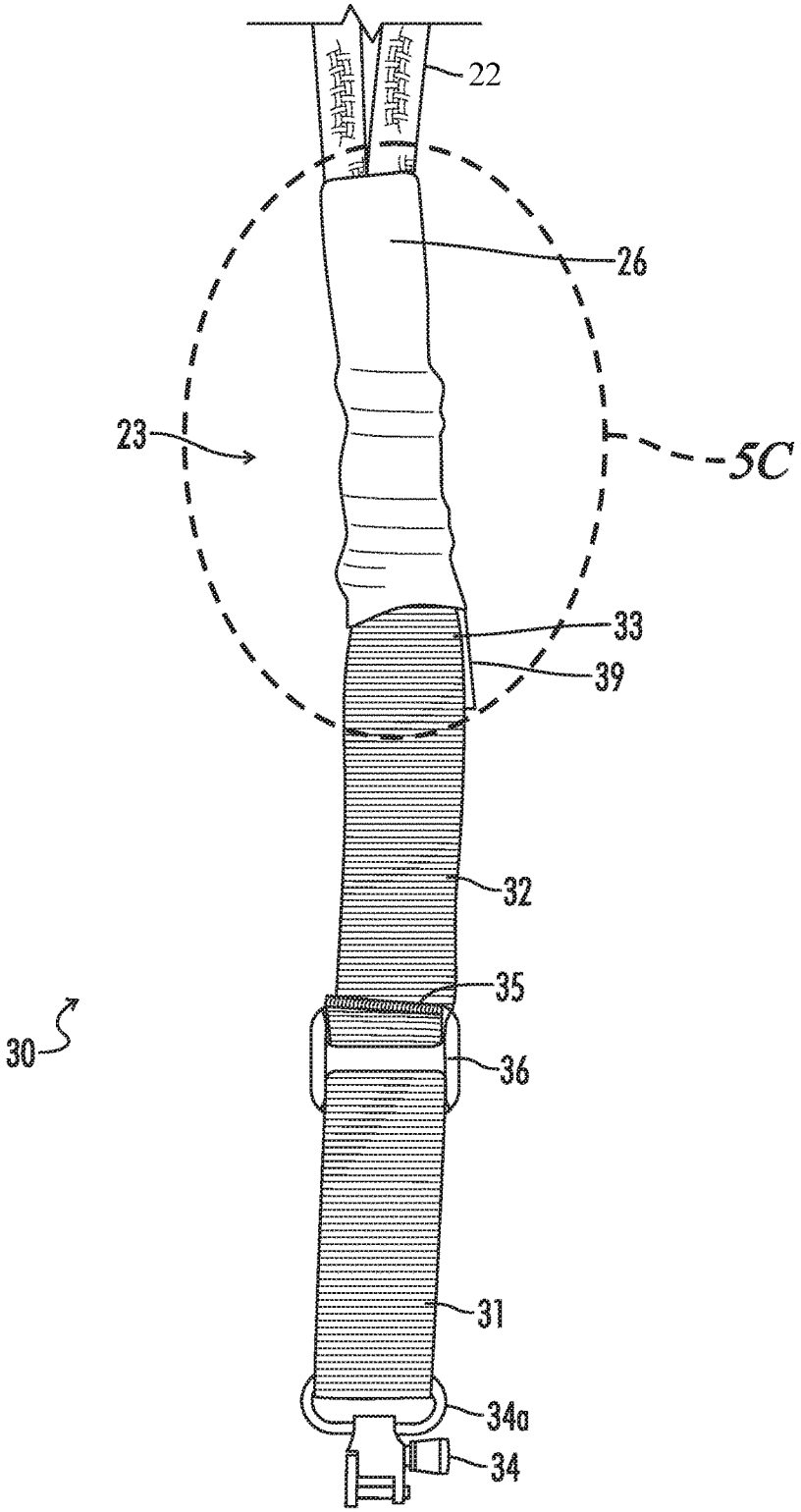

Referring now to FIGS. 2B, 3B, and 4B, the primary strap assembly includes a primary strap 32, an adjustable slide 36, a firearm attachment means 34 and, optionally, a label or logo tag 39. The primary strap 32 has a length defining a longitudinal axis, a width, a distal end portion 31 with a distal end 35, a proximal end portion 33 with a proximal end 37. Like secondary strap 42, the primary strap 32 can be formed from any flexible synthetic or natural material, including but not limited to nylon webbing and leather. In some embodiments, the primary strap 32 has a width of approximately 1.0 inches and a length of from about 12 to about 20 inches. In a preferred embodiment, the primary strap 32 has a width of approximately 1.0 inches and a length of about 16 inches. However, the width and length of the primary strap 32 can be varied to suit the height and frame of the user 90, or the size and weight of the firearm.

As shown in FIGS. 5A-5C, the proximal end portion 33 of the primary strap 32 is secured to the lower strap assembly attachment portion 23 of the sling loop 20 by first (upper) and second (lower) clamping means 28*a*, 28*b*, respectively, which are clamped or crimped around the proximal end portion 33 of the primary strap 32 and the end segments 25*a*, 25*b* of the elastic cord 22. Clamping means 28*a*, 28*b* prevent separation of strap 32 from elastic cord 22.

The proximal end portion 33 of strap 32 can be secured to the lower attachment portion 23 of sling loop 20 by first placing the proximal end portion 33 adjacent and parallel to end segments 25*a*, 25*b* of elastic cord 22 forming lower portion 23 of sling loop 20. A first clamping means 28*a* can then be placed around end segments 25*a*, 25*b* and proximal end portion 33. The proximal end portion 33 can then be folded down over the first clamping means 28*a* toward the distal end 35 of the primary strap 32 so that the proximal end portion 33 wraps around the first clamping means 28*a* and aligns with end segments 25*a*, 25*b*. A second clamping means 28*b* can then be placed around end segments 25*a*, 25*b* and proximal end portion 33 below the first clamping means 28*a*. The first and second clamping means 28*a*, 28*b* can then be tightened or crimped to secure the proximal end portion 33 of the strap 32 to the end segments 25*a*, 25*b* of the elastic cord 22.

In other embodiments, the primary strap 32 can be permanently attached to the lower strap assembly attachment portion 23 by any method or means that secures the primary strap assembly 30 to the lower attachment portion 23 and prevents the primary strap 32 from separating or pulling away from the sling loop 20 when the sling 10 is attached to and supporting the weight of a firearm. In preferred embodiments, it is intended that the primary strap 32 remain securely connected to the sling loop 22 to anchor the sling loop in a given orientation relative to an attached firearm. This enables the sling loop 20 to freely rotate around the portion of the user on which the sling 10 is worn as the firearm is moved around the user's body during use of the firearm or adjustment of the sling 10. However, in other embodiments, the primary strap assembly 30 can be releasably attached to the lower strap assembly attachment portion 23 of sling loop 20 in the same way that secondary strap assembly 40 is releasably attached to the upper strap assembly attachment portion 24 of sling loop 20.

As shown in FIGS. 2B, 3B, and 4B, the entire lower strap assembly attachment portion 23, including end segments 25*a*, 25*b*, the first and second clamping means 28,*a* 28*b*, and the proximal end portion 33 of the primary strap 32, is sheathed in a flexible covering 26 to prevent the clamping means 28*a*, 28*b* from snagging on a user's clothing or environment during use of the sling 10 to carry a firearm. The flexible covering 26 also prevents end segments 25*a*, 25*b* and proximal end 37 of primary strap 32 from unraveling, and protects proximal end portion 33 from being severed during use. The flexible covering 26 can be formed from any snag and tear-resistant, flexible material. In some embodiments, the flexible covering 26 is made of a durable polymeric material. In one embodiment, the flexible covering 26 is a section of plastic heat shrink tubing approximately 3.0 inches long by 1.25 inches wide and having a shrink rate of about 2 to 1.

Once the primary strap assembly 30 is secured to the lower strap assembly attachment portion 23 as disclosed above, the heat shrink tubing 26 can be applied to the sling 10 by sliding the section of heat shrink tubing 26 over the distal end portion 31 of the primary strap 32 and onto the lower attachment portion 23 so that the heat shrink tubing 26 covers cord segments 25*a*, 25*b*, clamping means 28*a*, 28*b*, and proximal end 37. Once the heat shrink tubing 26 is in place, a heat source can be used to heat and thereby shrink fit the tubing 26 to the lower attachment portion 23.

In some embodiments, a section of heat shrink tubing 26 can also be applied to secondary strap assembly 40 to sheath the portion of secondary strap 42 extending between adjustable loop 55 and ring 44*a* of firearm attachment means 44. However, sheathing secondary strap 42 in this way precludes use of adjustable slide 46, effectively making strap 42 non-adjustable, which may be preferable in some applications.

In some embodiments, a label or logo tag 39 can be adhered or sewn to the proximal end portion 33 of primary strap 32 to display a logo, brand name, or other indicia. In the embodiment depicted in FIG. 1, tag 39 is longitudinally aligned with a portion of the proximal end portion 33 of primary strap 32 and sewn to the primary strap 32 with a row of stitching as shown in FIGS. 5A-5B. The logo tag 39 is positioned on the proximal end portion 33 of the primary strap 32 so that the upper portion of the tag 39 is covered by flexible covering 26 and the principle display surface of the tag 39 extends outwardly from underneath the flexible covering 26.

The firearm attachment means 34 is a standard sling swivel 34 having a ring 34*a* around which a portion of the primary strap 32 is looped as shown in FIGS. 2B, 3B, and 4B. However, like the firearm attachment means 44 of secondary strap assembly 40, the firearm attachment means 34 of primary strap assembly 30 can, in other embodiments, be a quick detach sling swivel, a mechanical snap hook or D-ring, a carabiner, a trigger snap, a spring link, or a length of the distal end portion 31 of primary strap 32 sufficient to be tied to a portion of a firearm.

As best shown in FIG. 4B, the distal end portion 31 of primary strap 32 is releasably attached to firearm attachment means 34 by an adjustable loop formed with slide 36 around ring 34*a* of sling swivel 34. In the preferred embodiment shown in FIG. 4B, the loop is formed by threading the distal end 35 of strap 32 up from the bottom of adjustable slide 36 through one slot of the slide, over the central bar, back down from the top of the slide 36 through the second slot, through ring 34*a* of sling swivel 34, then back up from the bottom through the second slot, over the central bar and under the overlying layer of strap 32, and back down and out the first slot. The adjustable loop can be lengthened by holding a portion of strap 22 proximal to adjustable slide 36, and applying longitudinal pressure to the sides of slide 36 to slide the slide along the longitudinal axis of strap 32 toward the firearm attachment means 34. The loop can be shortened by holding the slide 36 and pulling the distal end 35 of strap 32.

Figure 6:
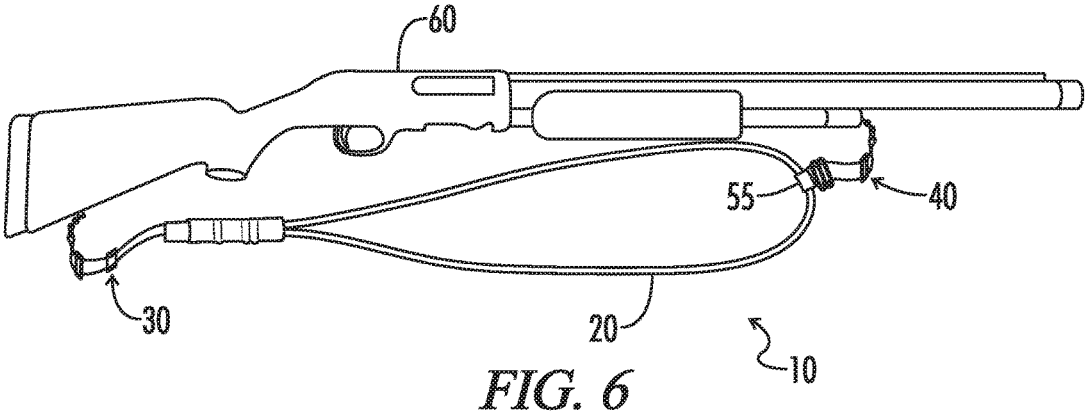
FIG. 6 is a perspective view of the sling of FIG. 1 showing the sling releasably attached to a shotgun.

Referring now to FIG. 6, there is shown the sling 10 installed on a shotgun 60. The firearm attachment means 34 of primary strap assembly 30 is releasably attached to a sling swivel stud extending from a portion of the buttstock near the rearward end of the shotgun 60. The firearm attachment means 44 of secondary strap assembly 40 is likewise releasably attached to a sling swivel stud extending from the magazine cap near the forward end of the shotgun 60. Sling loop 20 is sized to have an overall length less than the distance between the sling swivel studs extending from the rearward and forward ends of shotgun 60. Although the sling loop 20 can be sized to have an overall length longer than the distance between the sling swivel studs extending from the rearward and forward ends of shotgun 60, a lesser length ensures that the sling 10 will maintain the shotgun 60 proximate to the user's body during use by a user to carry the shotgun 60.

Figure 8:
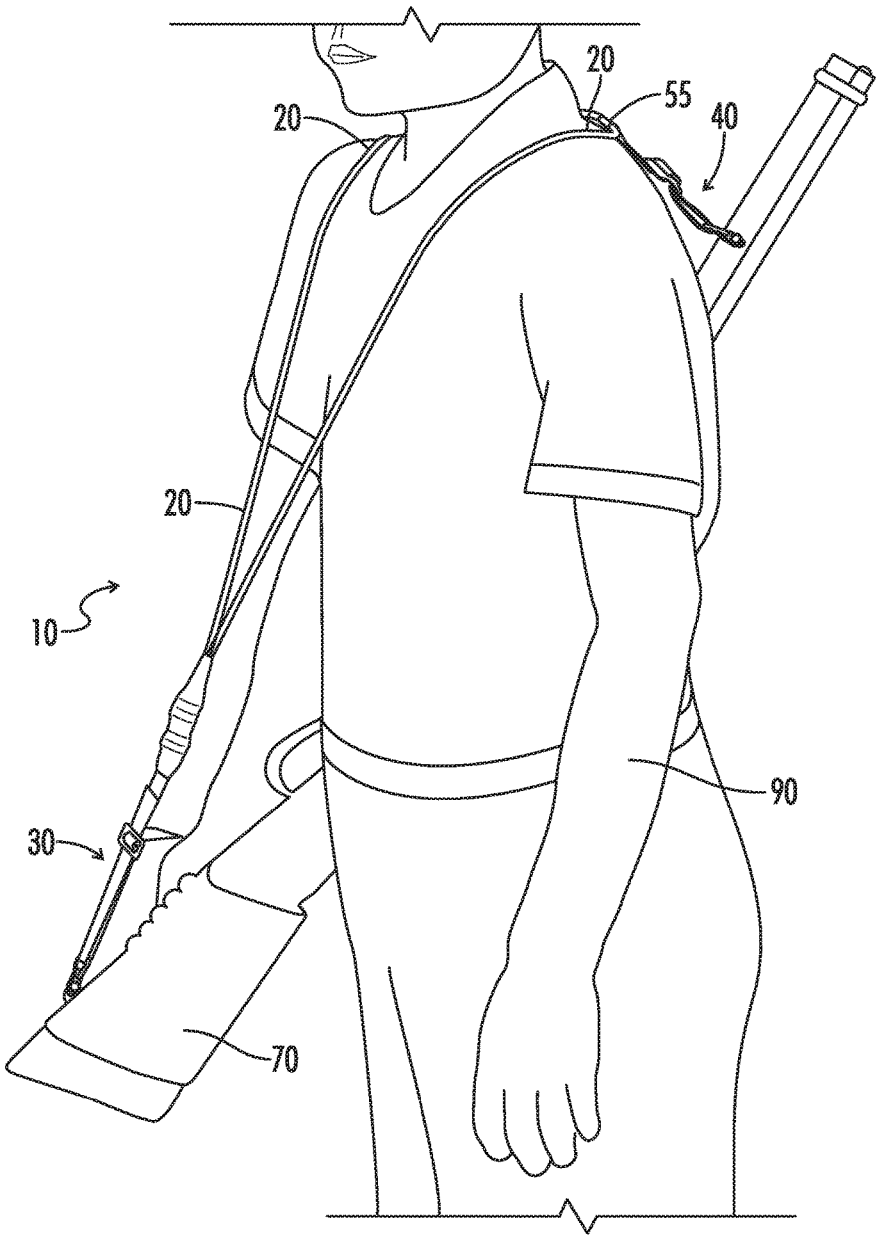
FIG. 8 is an environmental perspective view of the sling of FIG. 1 releasably attached to a rifle and being worn by a user in a three-point configuration.

When attached to a firearm as shown in FIG. 6, the sling 10 can be comfortably worn over one should of a user 90 in a traditional two-point configuration (not shown), or in a three-point configuration around the neck of a user 90 with the user's head extending though the sling loop 20 as shown in FIG. 8. When worn in the configuration shown in FIG. 8, the weight of the firearm will cause the elastic cord 22 to stretch and hold adjustable loop 55 of secondary strap assembly 40 in place on the sling loop 20 with adjustable loop 55 positioned between the user's shoulders. This advantageously distributes the weight of the firearm uniformly around the user's shoulders without placing pressure on or straining the user's neck.

Figure 7:
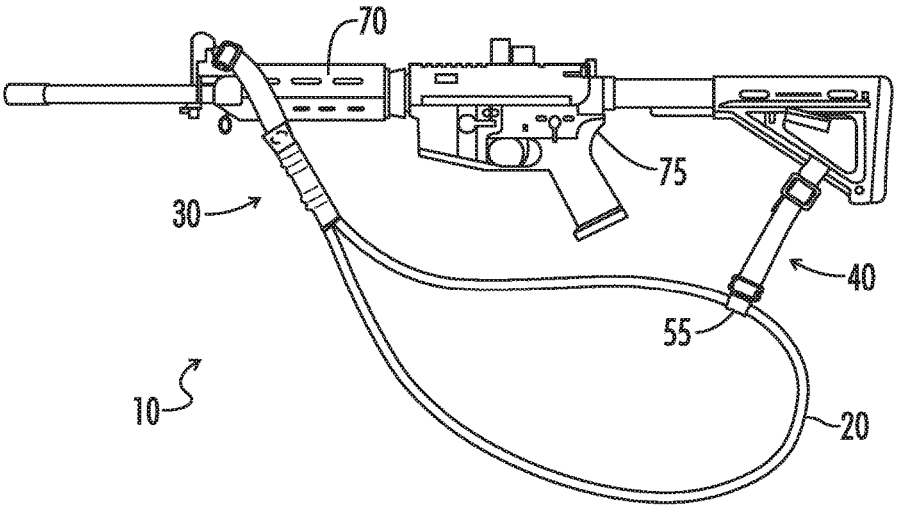
FIG. 7 is another perspective view of the sling of FIG. 1 showing the sling releasably attached to a rifle.

Referring now to FIG. 7, there is shown sling 10 installed on a rifle 70. In FIG. 7, the firearm attachment means 34 of primary strap assembly 30 is an adjustable loop releasably attached to a portion of the rifle 70 located near the forward end of the firearm. The firearm attachment means 44 of secondary strap assembly 40 is likewise releasably attached to a portion of the buttstock of the rifle 70 located near the rearward end of the firearm.

Figure 9:
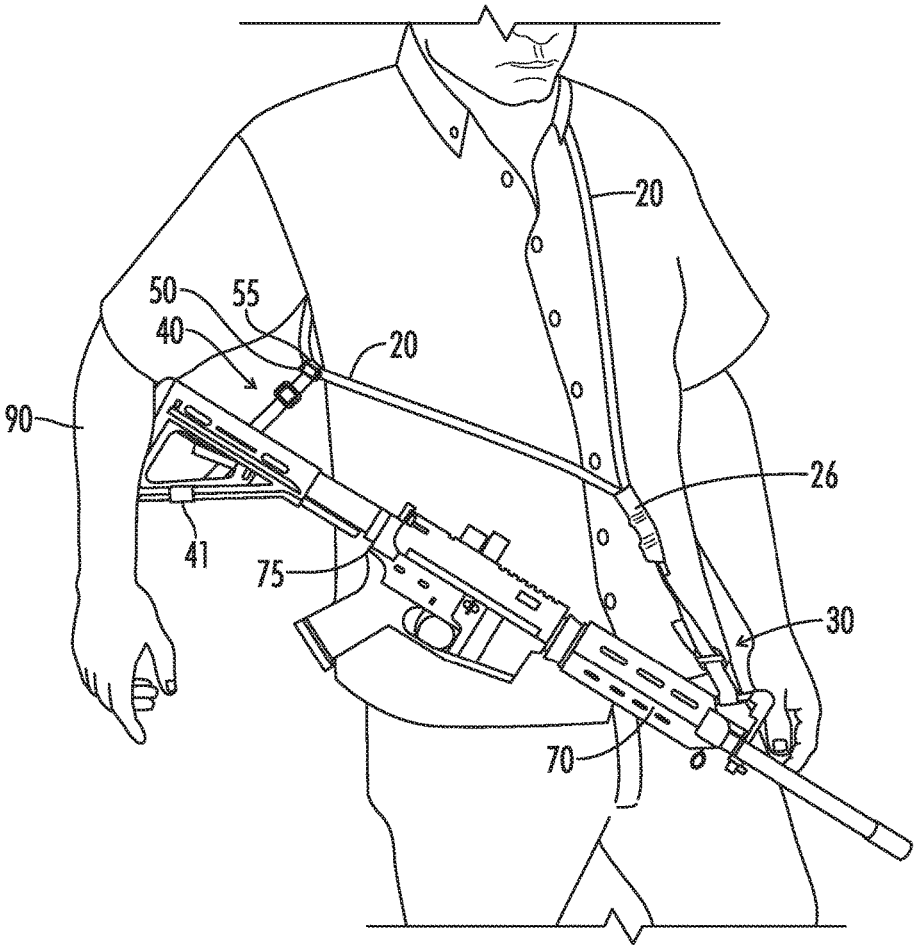
FIG. 9 is an environmental perspective view of the sling of FIG. 1 releasably attached to a rifle and being worn by a user in a different three-point configuration.

When attached to a firearm as shown in FIG. 7, the sling 10 can be comfortably worn around the torso of a user in a three-point configuration with the user's head, shoulder, and arm extending though the sling loop 20 as shown in FIG. 9. When worn as shown in FIG. 9, primary strap assembly 30 anchors the forward end of the rifle 70 in a generally forward pointing direction relative to the user, while secondary strap assembly 40 controls the angle of the rifle 70 relative to the ground. The angle of the barrel of the rifle 70 relative to the ground can be adjusted as desired by the user in light of the user's girth and the weight of the rifle 70 by manually sliding adjustable loop 55 forward or backward along the length of sling loop 20 until the desired carrying or firing position is achieved. As in other configurations, the weight of the rifle 70 will cause the elastic cord 22 to stretch and frictionally engage adjustable loop 55 once adjustable loop 55 has been positioned where desired along the length of sling loop 20, thereby holding secondary strap assembly 40 in place on the sling loop 20 where positioned by the user. The sling 10 will then comfortably support and distribute the weight of the rifle 70 around the user's torso and maintain the rifle 70 proximate to the user's body as shown in FIG. 9.

As explained above, the secondary strap assembly 40 can be detached from sling loop 20 to convert the sling 10 into a single-point configuration. In such configuration, the primary strap assembly 30 can easily be releasably attached to the buttstock of the rifle 70 or a single point sling attachment point 75 located at the rear of the receiver of the rifle 70.

Interpretation

As used herein, the term "closed loop" means the structure formed by a bend or curve that touches or crosses itself. The term "closed loop" includes the structure formed by a strip of bent or curved material having two opposing end portions that touch, cross, or are otherwise adjoined to each other. The negative space or area defined by a closed loop is referred to herein as the "eye" of the loop.

As used herein, the term "static loop" means a closed loop having an eye defining an area of fixed size and does not require that the eye have a fixed shape.

As used herein, the term "adjustable loop" means a closed loop that can be tightened or loosened to change the size of the eye or even release (i.e., open or undo) the loop.

As used herein, "releasably attached" means attached in way designed to easily unattach and reattach (e.g., by hand without a tool being necessary). Exemplary means for releasable attachment include adjustable loops and fasteners. Exemplary fasteners for releasable attachment include a standard sling swivel, a quick detach sling swivel, a mechanical snap hook or D-ring, a carabiner, a trigger snap, a spring link, a quick release buckle, a buckle, and the like.

This description and appended claims include the words "below", "above", "side", "top", "bottom", "upper", "lower", "when", "upright", etc. to provide an orientation of embodiments of the invention to allow for proper description of example embodiments. The foregoing positional terms refer to the apparatus when in the orientation shown in FIG. 1. A person of skill in the art will recognize that the apparatus can assume different orientations when in use. It is also contemplated that embodiments of the invention may be in orientations other than upright without departing from the spirit and scope of the invention as set forth in the appended claims. Further, it is contemplated that "above" means having an elevation greater than, and "below" means having an elevation less than such that one part need not be directly over or directly under another part to be within the scope of "above" or "below" as used herein.

The phrase "in one embodiment," as used herein does not necessarily refer to the same embodiment, although it may. Conditional language used herein, such as, among others, "can", "might", "may", "e.g.," and the like, unless specifically stated otherwise, or otherwise understood within the context as used, is generally intended to convey that certain embodiments include, while other embodiments do not include, certain features, elements and/or states.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A sling for a firearm, comprising:

an elastic cord formed in a static loop through which a user's head is receivable, the static loop having an upper portion and a lower portion, the lower portion including a first end segment and a second end segment disposed side by side with the first end segment, each end segment having an end facing in the same direction;

a primary strap secured to the lower portion of the static loop, the primary strap including a proximal end portion and a distal end portion opposite the proximal end portion, the proximal end portion secured to the first and second end segments of the static loop by a clamping means around which the proximal end portion of the primary strap is wrapped, the clamping means placing sufficient compressive force on the first and second end segments and the proximal end portion of the primary strap to prevent separation of the primary strap from the cord; and a secondary strap attached to the upper portion of the static loop;

wherein the elastic cord supports and distributes the weight of a firearm and maintains the firearm proximate to the user's body when the primary and secondary straps are connected to the firearm and the user's head is received through the static loop.

2. The sling of claim 1, further comprising a flexible covering in which the first and second end segments of the static loop, the proximal end portion of the primary strap, and the clamping means are sheathed to prevent the sheathed portion of the sling from snagging on a user's clothes or environment.

3. The sling of claim 1, further comprising a slide through which the distal end portion of the primary strap is threaded to form an adjustable loop for releasable attachment to a firearm or a firearm attachment means, wherein said adjustable loop is adjustable by manually sliding the slide along a longitudinal axis of the primary strap.

4. The sling of claim 3, further comprising firearm attachment means connected to the distal end portion of each of the primary and secondary straps for releasably attaching the primary and secondary straps to said firearm.

5. The sling of claim 4, wherein said firearm attachment means is a sling swivel.

6. The sling of claim 1, wherein said secondary strap is selectably detachable from the static loop to convert the sling into a single point sling.

7. The sling of claim 1, wherein the secondary strap includes a distal end portion having a distal end and a proximal end portion having a proximal end, the proximal end portion in slidable frictional engagement with the static loop.

8. The sling of claim 7, further comprising a slide having a frame and a central bar defining first and second slots through which the proximal end portion of the secondary strap is threaded, the distal end portion of the secondary strap being wrapped around a section of cord forming a portion of the static loop and threaded back through the second and first slots over the proximal end portion to form an adjustable loop around the cord, wherein the adjustable loop is manually slidable along a length of the static loop to adjust the sling to suit different carrying and firing positions.

9. The sling of claim 8, wherein the proximal end of the secondary strap is secured to a portion of the secondary strap distal to its proximal end such that the proximal end portion forms a static loop around the central bar of the slide.

10. The sling of claim 8, wherein withdrawing the distal end of the secondary strap from the first and second slots releases the secondary strap from the static loop.

* * * * *